US010438755B1

(12) United States Patent
Schultz, Sr.

(10) Patent No.: US 10,438,755 B1
(45) Date of Patent: Oct. 8, 2019

(54) SWITCH WITH ACCIDENTAL SHUT OFF ALARM

(71) Applicant: David S. Schultz, Sr., Miller Place, NY (US)

(72) Inventor: David S. Schultz, Sr., Miller Place, NY (US)

( * ) Notice: Subject to any disclaimer, the term of this patent is extended or adjusted under 35 U.S.C. 154(b) by 0 days.

(21) Appl. No.: 16/150,626

(22) Filed: Oct. 3, 2018

(51) Int. Cl.

| | |
|---|---|
| ***H05B 37/02*** | (2006.01) |
| ***H01H 9/16*** | (2006.01) |
| ***G08B 21/18*** | (2006.01) |
| ***F24F 11/30*** | (2018.01) |
| ***H01H 9/02*** | (2006.01) |

(52) U.S. Cl.
CPC ..... *H01H 9/168* (2013.01); *F24F 11/30* (2018.01); *G08B 21/185* (2013.01); *H01H 9/0271* (2013.01); *H01H 2215/03* (2013.01); *H01H 2215/044* (2013.01)

(58) Field of Classification Search
None
See application file for complete search history.

(56) References Cited

U.S. PATENT DOCUMENTS

| | | | | |
|---|---|---|---|---|
| 3,999,175 | A | 12/1976 | Thibodeau | |
| 4,592,197 | A * | 6/1986 | Wolf | D01H 1/36 242/478.3 |
| 4,706,073 | A | 11/1987 | Vila Masot | |
| 4,992,777 | A | 2/1991 | Keisuke et al. | |
| 5,555,456 | A | 9/1996 | Waite | |
| 5,914,826 | A | 6/1999 | Smallwood | |
| 5,916,087 | A * | 6/1999 | Owens | F41A 23/18 224/243 |
| 6,375,430 | B1 | 4/2002 | Eckert et al. | |
| 7,408,476 | B1 * | 8/2008 | Beaton | H01H 9/287 340/426.24 |
| 7,608,948 | B2 | 10/2009 | Nearhoof et al. | |
| 9,063,040 | B2 | 6/2015 | Calio et al. | |
| 9,406,456 | B2 | 8/2016 | O'Keeffe | |
| 9,625,511 | B2 | 4/2017 | Chen et al. | |
| 2006/0044133 | A1 | 3/2006 | Lou | |
| 2009/0103228 | A1 * | 4/2009 | Elderbaum | H01H 9/167 361/187 |
| 2014/0265577 | A1 * | 9/2014 | Beckman | H02J 3/14 307/39 |
| 2017/0314982 | A1 | 11/2017 | Shah et al. | |

FOREIGN PATENT DOCUMENTS

| | | |
|---|---|---|
| CN | 2052570 | 2/1990 |
| WO | 2001037466 A3 | 5/2001 |

* cited by examiner

*Primary Examiner* — Brent Swarthout
(74) *Attorney, Agent, or Firm* — Tutunjian & Bitetto, P.C.

(57) ABSTRACT

A switch that is designed for use as an "emergency" shut off for heating, air conditioning (AC) systems or appliances is provided, but is certainly not limited to these specific applications and has applications in many other fields. The switch is configured with one or more indicators (visual and/or audible) configured to indicate when the switch has been manually turned off, even though power to the switch is still active. In this manner when the switch has been accidentally or inadvertently turned off by an unsuspecting user, they will be notified that the connected appliance (e.g. heating or AC system) has also been turned off.

8 Claims, 4 Drawing Sheets

SWITCH WITH ACCIDENTAL SHUT OFF ALARM

BACKGROUND

Technical Field

The present principles relate to switches. More particularly, it relates to an accidental turn off alarm for switches used for appliances or HVAC systems.

Related Art

Generally speaking, most consumers who live in a home or apartment, have a heating or air conditioning system that includes an "emergency" shut off switch. Often, this emergency shut off switch is located at the top of the basement stairs, or if no basement, in an area that is away from the actual heating and/or AC system. The emergency shut off switch also often includes a switch plate that identifies it as such. FIG. 1 shows an example of such a switch plate 1.

Notwithstanding the existence of these emergency switches and the switch plates used to clearly identify them, it is very common for these switches to be "accidentally" shut off by the homeowner or individual living in the premises. Examples of such situations exist when someone is carrying laundry or other items and accidentally brushes against the switch, causing the same to be turned off. In other instances, these emergency shut off switches are not marked with the example switch plate of FIG. 1, and the user doesn't know the same is connected to their heating or air conditioning systems. In yet other situations, the switches are located at the appliance itself (e.g., heating boiler, hot water heater, etc.), and are generally for the service individual to use.

The switches used for these emergency shut off are generally standard toggle switches often used for household lighting, and do not have any special requirements in order to operate as this emergency switch. The result of accidental shut off is the homeowner's heating and/or AC systems is turned off, and they will not know about it, sometimes for days (e.g., until the home gets cold or warm based on the lack of heat or AC respectively.

Mechanical systems such as covers and protectors are available to assist in the preventing the homeowner from accidentally or mistakenly shutting off these switches. However, such systems sometimes fail, and the result is the switch has been turned off and no one knows until it is too late.

It is therefore desirable to have a switch that is designed for this "emergency" shut off purpose or for use by service individuals in areas on or for specific appliances, and that has at some form of audible and/or visual indicator that notifies the user that it has been shut off. Unlike switch systems that have the ability to notify the user of when power to the switch has been lost, the present invention is not directed to the situation when the switch loses power, but to when some manual intervention (e.g., accidental) causes the switch to be turned off.

SUMMARY

According to an implementation, the electric switch includes a housing and at least two terminals positioned on the housing, one for connecting to a line power source and the other for connecting to an appliance. A toggle switch is positioned within the housing and connected to the terminals. The toggle switch is configured to connect the at least two terminals in an on position, and disconnect the terminals in an off position. An indicator is provided on the toggle or on the housing for notifying a user that the toggle switch has been manually moved to the off position while the line power source to the terminal is still active According to another implementation, the electric switch includes a housing and at least two terminals positioned on the housing, one for connecting to a line power source and the other for connecting to an appliance. A switch positioned within the housing and connected to the terminals. The switch configured to connect the at least two terminals in an on position, and disconnect the terminals in an off position. A light is provided within the toggle switch, and a speaker is positioned in the housing. Manual movement of the toggle switch to the off position causes the light to blink and the speaker to emit an audible sound while the line power source to the terminal is still active.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

The present principles are directed to switches used for systems or appliances that are intended to allow the user, in emergency situations (e.g. fire), to shut off the respective system or appliance.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Figure 2:
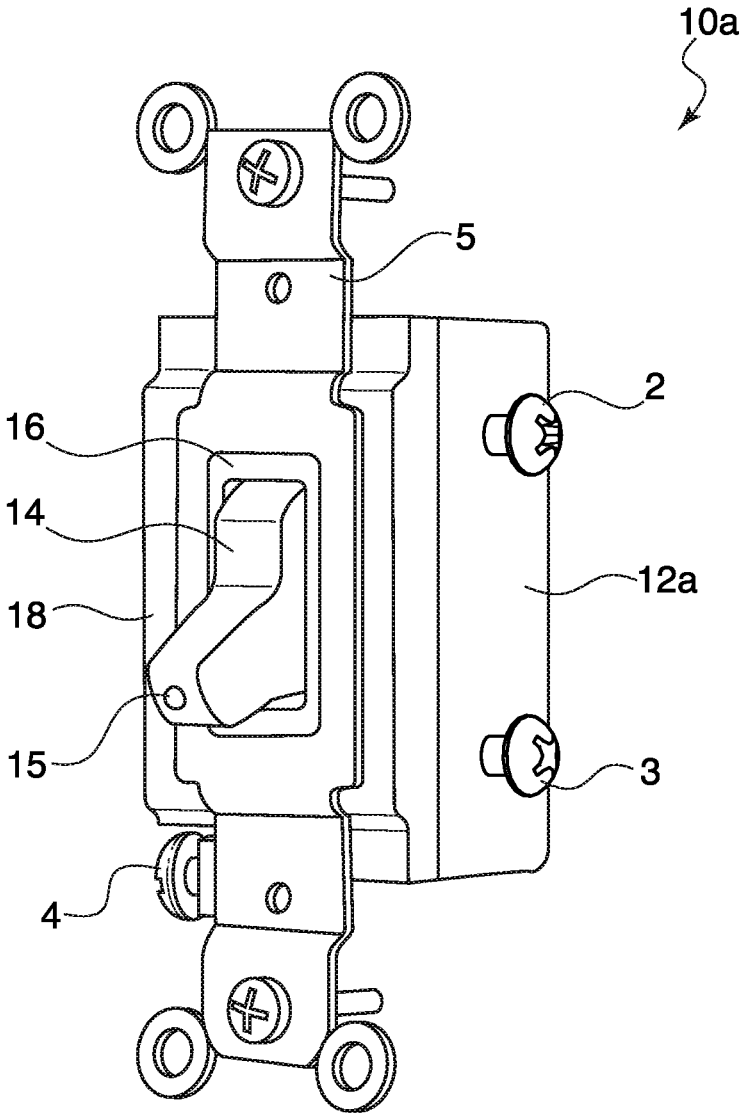
FIG. 2 is a perspective view of the switch with accidental shut off alarm according to an embodiment of the present principles.

Referring to FIG. 2, there is shown a switch 10A according to an implementation of the present principles. The switch includes a housing 12B that houses the mechanicals and/or electronics associated with the switch and terminals 2 and 3. One of the terminals 2 or 3 is configured to be connected to a line power source (from the home), and other of the terminals 3 or 2 is configured to be connected to an appliance (e.g., HVAC system, a hot water heater or any other appliance of any kind). The ground terminal 4 is generally outside housing 12B and electrically connected to the metal framing 5. On the front of the housing 12B there is toggle switch 14. The toggle switch 14 can be internally illuminated with a light 15 (e.g. red), and the portion 16 around the switch 14 can be configured to also be illuminated with a color (e.g., green).

For purposes of clarification, the manual turning off of the switch 10, as referred to herein, does not include situations or scenarios when power to the switch (from the line source or power provider) has been lost. As referred to herein, the manual turning off of the switch is intended to mean the "accidental" manual intervention that results in the turning off of the switch.

Figure 3:
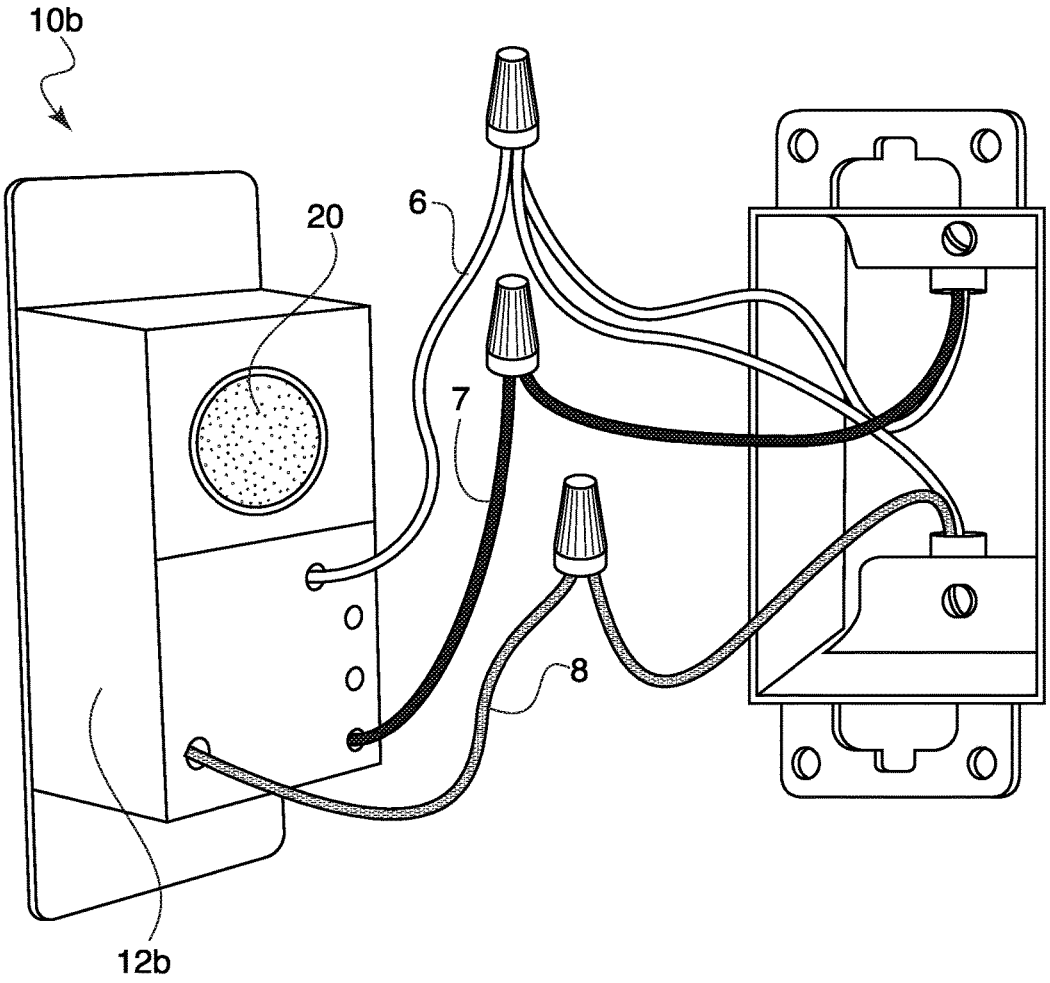
FIG. 3 is a rear view of the switch with accidental shut off alarm according to another embodiment of the present principles.

FIG. 3 shows an alternative implementation of the switch 10B having a housing 12B. In the implementation, the switch does not have terminals, but rather has wires 6, 7 and 8 coming out of the same. As shown, the switch 10B includes a speaker 20 positioned somewhere on the housing 12B. Although not shown in FIG. 2, speaker 20 can also be included in that implementation, in addition to the lighting 15 and 16.

Figure 1:
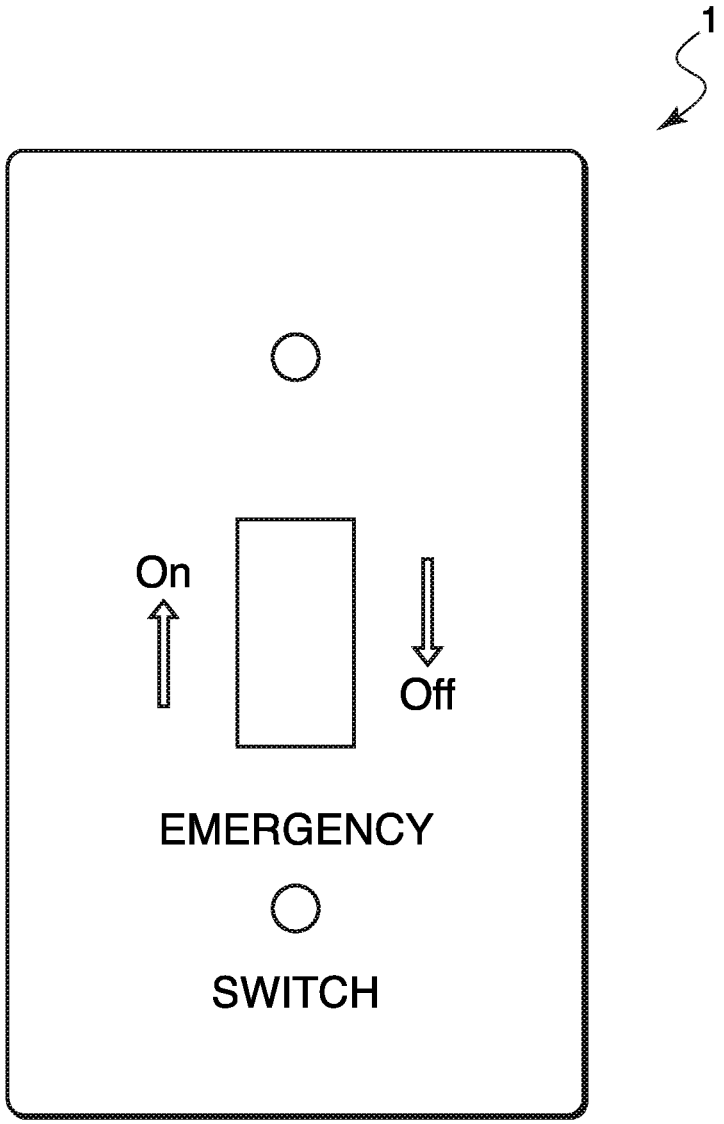
FIG. 1 is an example of an emergency light switch plate.

During operation, the switch 10 can be installed for use with a home boiler (gas or oil), an Air Conditioning system, or HVAC systems or other types of appliances. As described above, these systems often have the "emergency" switch (identified by the switch plate of FIG. 1) for the customer. Once installed, and turned on, the switch is in working order and a green light 16 may be illuminated indicating that the switch is on. In the event the customer turns off the switch (either intentionally or accidentally), the red light 15 in the toggle switch 14 will illuminate, and preferably blink, and the speaker 20 will emit an audible sound (e.g., a consistent beeping or a constant tone).

Thus, whenever the switch 10 is manually turned off, it will blink the red light 15 and/or emit an audible sound via speaker 20, thereby notifying the owner of the home or business that the emergency switch has been turned off.

As will be appreciated, the switch 10 of the present principles has tremendous applications for those that are hearing impaired or sight impaired. For the hearing impaired, the blinking light 18 that indicates the light switch is off will notify these users that the switch has been accidentally turned off, and thus so has the power to the connected appliance. For the sight impaired, the audible sound emitted from the speaker 20 will operate to inform these users that the emergency switch has been turned off, and thus so has the power to the connected appliance. The switch of the present principles also has applications for homes with elderly occupants. In this situation, it will notify the elderly people when the switch is turned off, and clearly before a dangerous condition is presented (e.g., no heat in the middle of the winter or no AC in the middle of a very hot summer).

It will be apparent to those of skill in the art, that the switch 10 of the present principles does not inform the user when power to the switch itself is lost, but rather uses the power to the switch to notify the user (audibly and/or visually) when the same has been simply turned off by some manual intervention.

Figure 4:
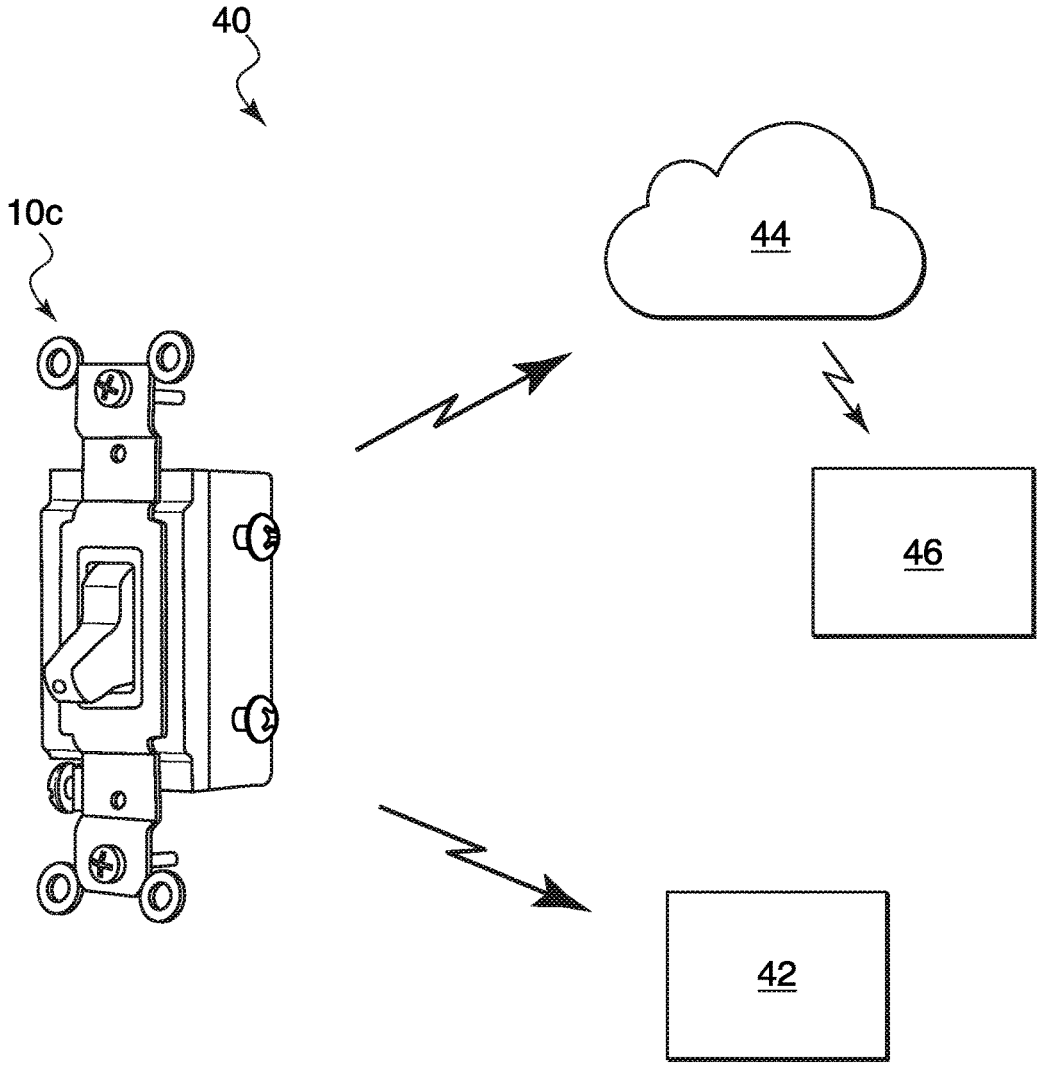
FIG. 4 is a system overview of the switch with accidental shut off alarm according to yet another embodiment of the present principles.

Referring to FIG. 4, there is shown a system 40 for informing users as to the accidental turning off of the switch 10C. In one implementation, the switch 40 includes RF wireless circuitry and is wireless communication with a user's smartphone device 42. An example of such wireless communication could be any RF wireless technology, such as, for example, Bluetooth. An application running on the smartphone device 42 can be configured to indicate the switch status (i.e., on or off), and provide the user with a notification on their smartphone (visual or audible) when the switch 10C has been turned off.

In an alternative implementation, the switch 10C is connected to the user's home wireless (WiFi) network 44 which in turn, is in communication with one or more user connected devices 46. In this configuration, when switch 10C is turned off, a signal can be sent to the user's device 46 via their home WiFi network providing a notification that the switch has been accidentally turned off. In another alternative implementation, the network 44 could be a cellular network and allow the communication of the power status to a device 46 that is, for example, owned by a family member of the person living in the household with the switch 10.

Although switch 10 has been shown as a standard toggle switch as these are most often the ones "accidentally" turned off, it will be appreciated that the present principles can be applied to any type of switch (e.g., push buttons, slide or dial switches) at any type of voltage (e.g., 110V or 220V).

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. An electric switch comprising:

a housing;

at least two terminals accessible from an exterior of the housing, one for connecting to a line power source and the other for connecting to an appliance;

a switch positioned within the housing and internally connected to the terminals, the switch configured to internally connect the at least two terminals and thus the line power source to the appliance in an on position, and disconnect the terminals in an off position; and an indicator electrically connected inside the housing to the line power source for notifying a user that the switch has been manually moved to the off position while the line power source to the terminal is still active.

2. The electric switch according to claim 1, wherein said indicator comprises a blinking light positioned on the switch.

3. The electric switch according to claim 1, wherein said indicator comprises a speaker positioned anywhere on the housing and configured to emit a tone when the switch is manually placed in the off position.

4. The electric switch according to claim 1, further comprising wireless communication circuitry contained within the housing and configured to wirelessly send the indication of the manual shut off of the switch to a remotely located device in communication with said wireless communication circuitry.

5. The electric switch according to claim 1, further comprising wireless communication circuitry contained with the housing and configured to be connected to a user's home wireless network, the switch being further configured to wirelessly send the indication of the manual shut off of the switch, via the user's home wireless network, to one or more remotely located devices connected to the user's home wireless network.

6. An electric switch comprising:

a housing;

at least two terminals accessible from an exterior of the housing, one for connecting to a line power source and the other for connecting to an appliance;

a switch positioned within the housing and internally connected to the terminals; the switch configured to connect the at least two terminals and thus the line power source to the appliance in an on position, and disconnect the terminals in an off position;

a light within the switch; and a speaker positioned in the housing;

the light and the speaker being electrically connected to the line power source inside the housing such that manual movement of the switch to the off position causes the light to blink and the speaker to emit an audible sound while the line power source to the terminal is still active.

7. The electric switch according to claim 6, further comprising wireless communication circuitry contained within the housing and configured to wirelessly send an indication of the manual shut off of the switch to a remotely located device in communication with said wireless communication circuitry.

8. The electric switch according to claim 6, further comprising wireless communication circuitry contained with the housing and configured to be connected to a user's home wireless network, the switch being further configured to wirelessly send an indication of the manual shut off of the switch, via the user's home wireless network, to one or more remotely located devices connected to the user's home wireless network.

* * * * *